US009945651B2

(12) United States Patent
McNelis et al.

(10) Patent No.: US 9,945,651 B2
(45) Date of Patent: Apr. 17, 2018

(54) PACKING FOR HOLLOW CHARGES

(75) Inventors: Liam McNelis, Bonn (DE); Arash Shahinpour, Troisdorf (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 476 days.

(21) Appl. No.: 14/006,678

(22) PCT Filed: Mar. 27, 2012

(86) PCT No.: PCT/EP2012/055432
§ 371 (c)(1),
(2), (4) Date: Sep. 22, 2013

(87) PCT Pub. No.: WO2012/130854
PCT Pub. Date: Oct. 4, 2012

(65) Prior Publication Data

US 2014/0008247 A1 Jan. 9, 2014

(30) Foreign Application Priority Data

Mar. 29, 2011 (DE) ..... 10 2011 015 460

(51) Int. Cl.
*F42B 39/00* (2006.01)
*F42B 39/14* (2006.01)
(Continued)

(52) U.S. Cl.
CPC ..... *F42B 39/14* (2013.01); *F42B 39/20* (2013.01); *F42B 39/22* (2013.01); *F42B 39/24* (2013.01)

(58) Field of Classification Search
CPC ..... B65D 5/448; B65D 77/0413
(Continued)

(56) References Cited

U.S. PATENT DOCUMENTS 4,389,947 A * 6/1983 King ..... F42D 5/045 109/1 S
4,923,066 A 5/1990 Ophir et al.
(Continued)

FOREIGN PATENT DOCUMENTS

DE 3805478 A1 8/1989
DE 102009031443 A1 1/2010
(Continued)

OTHER PUBLICATIONS

EP_1422148_translation.pdf.*
(Continued)

*Primary Examiner* — J. Gregory Pickett
*Assistant Examiner* — Allan Stevens
(74) *Attorney, Agent, or Firm* — Lisa J. Moyles; Janelle A. Bailey

(57) ABSTRACT

A packaging for hollow charges for use in blasting applications in boreholes retains fragments in the event of unintentional ignition of the hollow charges. The packaging withstands and dissipates the pressure generated. It is proposed that the hollow charges are embedded in a solid material which captures the fragments, the solid material has pressure relief openings through which the pressure generated during a detonation of the hollow charges can escape, the solid material is covered with shock-absorbing material on the top side and on the base side of the packaging, the hollow charges are packed in pairs such that there are always two hollow charges situated with their openings facing each other, the axes of symmetry of the hollow charges are arranged in a plane perpendicular to the top side and base side, and the solid material is inserted with the hollow charges and the shock-absorbing material into a cage.

12 Claims, 4 Drawing Sheets

(51) Int. Cl.

| | |
|---|---|
| ***F42B 39/22*** | (2006.01) |
| ***F42B 39/24*** | (2006.01) |
| ***F42B 39/20*** | (2006.01) |

(58) Field of Classification Search

USPC ..... 86/50; 102/331, 306–310, 476; 206/3, 206/521, 585, 591, 593, 594, 523; 109/49.5

See application file for complete search history.

(56) References Cited

U.S. PATENT DOCUMENTS

| | | | | |
|---|---|---|---|---|
| 7,416,076 | B2 * | 8/2008 | Barton | F42B 39/00 206/3 |
| 7,546,917 | B1 * | 6/2009 | Lam | B65D 71/70 206/3 |
| 2002/0092793 | A1 | 7/2002 | Barker | |

FOREIGN PATENT DOCUMENTS

| | | | | |
|---|---|---|---|---|
| EP | 0800053 | A1 | 10/1997 | |
| EP | 1422148 | A1 * | 5/2004 | B65D 5/448 |
| EP | 1736728 | A2 | 12/2006 | |
| FR | 2656684 | A1 | 12/1989 | |
| RU | 2131583 | C1 | 6/1999 | |
| RU | 2227266 | C1 | 4/2004 | |
| RU | 2266515 | C1 | 12/2005 | |
| RU | 85997 | U1 | 3/2009 | |
| WO | 2001/025667 | A2 | 4/2001 | |
| WO | 2010/003858 | A1 | 1/2010 | |

OTHER PUBLICATIONS

PCT/EP2012/055432 International Search Report in English dated Jun. 21, 2012.

PCT/EP2012/055432 International Preliminary Report on Patentability in English dated Oct. 2, 2013.

* cited by examiner 6
5c
10
5b
10
5a
6
11
13
2
14
12
1
20
5
5
5
4
4
4
2
14
(Fig.4)

PACKING FOR HOLLOW CHARGES

CROSS-REFERENCE TO RELATED APPLICATIONS

This application claims priority to PCT Application No. PCT/EP2012/055, filed Mar. 27, 2012, which claims priority to German Patent Application No. 102011015460.4, filed Mar. 29, 2011, each of which are incorporated herein by reference in their entirety.

FIELD OF THE INVENTION

The invention relates to a packaging having a top side, a base side and face sides for hollow charges for use in blasting applications in boreholes.

BACKGROUND OF THE INVENTION

According to the prior art, hollow charges—also referred to in the art as "hollow shaped charges"—for use in blasting applications in boreholes are packed in pairs in a pack. No protection against fragments is provided. Usually, the whole packaging is made of cardboard and, if necessary, a vacuum bag to protect against moisture.

The packaging is only suitable to a limited extent for capturing fragments, which are generated in the packaging when a hollow charge is initiated. The criteria which are specified by the official 6(d) test are not fulfilled.

As well as the existing criteria of the official 6(a), 6(b) and 6(c) test, the packaging must also withstand the "Test 6(d) Unconfined Package Test (UN)" in the "UN Manual of Tests and Criteria".

The requirements of the official 6(d) Unconfined Package Test dictate that all hazardous effects caused by the reaction of a hollow charge in the packaging must be restricted to the packaging.

Indications of a hazardous effect outside the packaging are:

(a) Denting or perforation of a verification plate under the packaging;

(b) A flash or a flame is produced, which ignites a material lying next to the packaging, such as a sheet of paper (80±10 g/cm$^2$) at a distance of 25 cm from the packaging;

(c) Tearing of the packaging and ejection of the contents of the packaging, or (d) An ejected part, which completely punctures the packaging (an ejected part or fragment retained or sticking in the wall of the packaging is not considered to be hazardous).

BRIEF DESCRIPTION OF THE INVENTION

The invention is based on the object of specifying a packaging for hollow charges, which, in the event of an unintentional ignition of the hollow charges, retains the fragments, withstands the pressure generated in the packaging and permits a dissipation of pressure.

According to the invention this object is achieved by the characteristics of claim 1, in which a packaging is provided having a top side, a base side and face sides for hollow charges for use in blasting applications in boreholes, characterized in that the hollow charges are embedded in a solid material, which captures the fragments generated during a detonation of the hollow charges. The packaging has pressure relief openings through which a pressure wave of gas volume generated during a detonation of the hollow charges can escape. The packaging includes a shock-absorbing material on the top side and on the base side of the packaging. The hollow charges are packed in pairs such that there are always two hollow charges situated with their openings facing each other and the axes of symmetry of the hollow charges are arranged in a plane perpendicular to the top side and base side of the packaging, and the plurality of layers is inserted with the hollow charges and the shock-absorbing material into a cage, preferably a grate-type cage.

BRIEF DESCRIPTION OF THE FIGURES

A more particular description of the invention briefly described above will be rendered by reference to specific embodiments thereof that are illustrated in the appended drawings in which.

DETAILED DESCRIPTION

Figure 1:
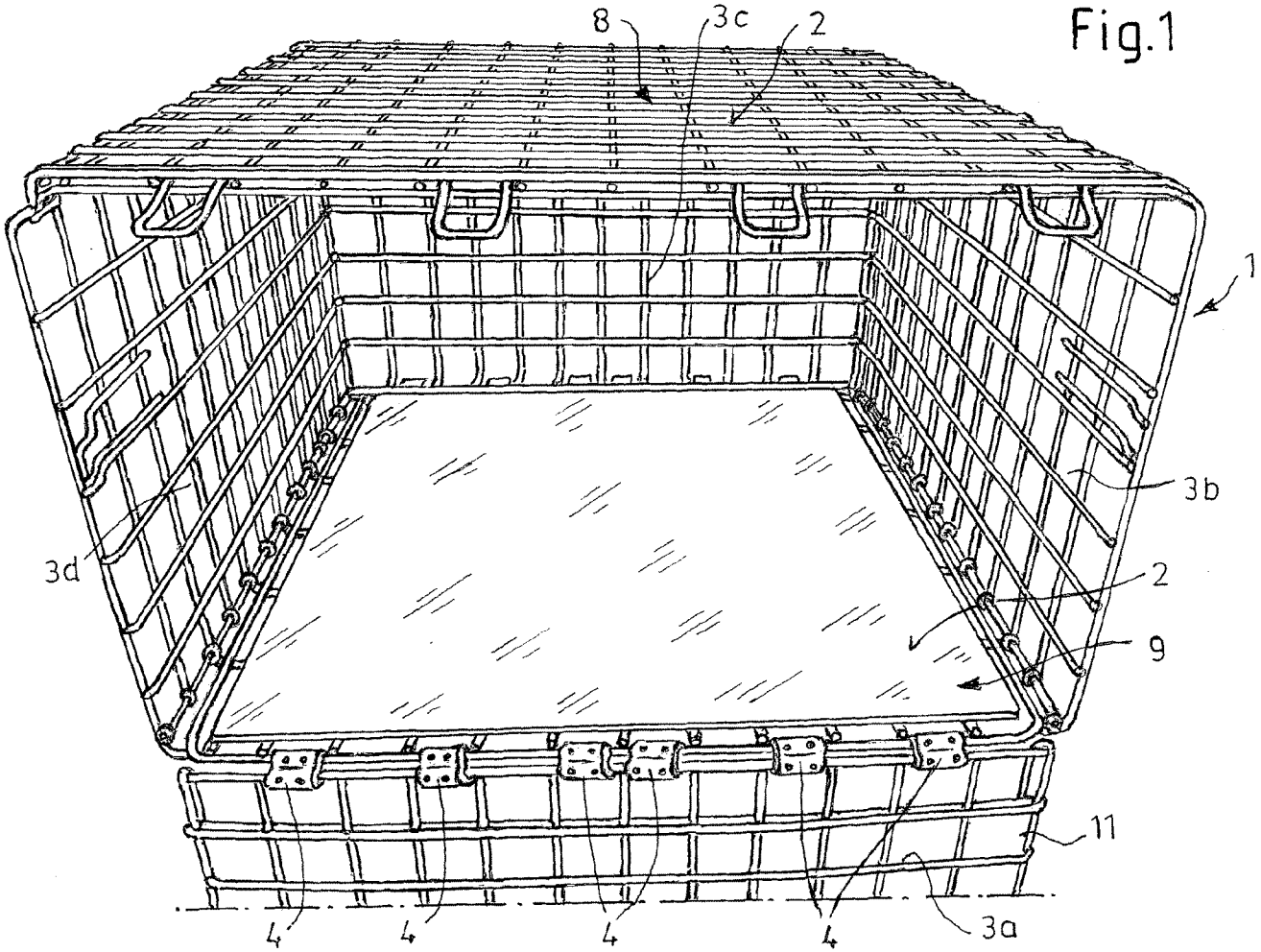
FIG. 1 is a perspective view of a packaging according to an embodiment of the invention.

In an embodiment of the invention, a packaging is provided having a top side, a base side and face sides for hollow charges for use in blasting applications in boreholes, characterized in that the hollow charges are embedded in a solid material which captures the fragments generated during a detonation of the hollow charges, the solid material has pressure relief openings through which the pressure wave of the gas volume generated during a detonation of the hollow charges can escape, the solid material is covered with shock-absorbing material on the top side and on the base side of the packaging, the hollow charges are packed in pairs such that there are always two hollow charges situated with their openings facing each other, the axes of symmetry of the hollow charges are arranged in a plane perpendicular to the top side and base side, and the solid material is inserted with the hollow charges and the shock-absorbing material into a cage, preferably a grate-type cage.

According to the invention this object is achieved because a) the hollow charges are embedded in a solid material which captures the fragments generated during a detonation of the hollow charges, b) the solid material has pressure relief openings through which the pressure wave of the gas volume generated during a detonation of the hollow charges can escape, c) the solid material is covered with shock-absorbing material on the top side and on the base side of the packaging, d) the hollow charges are packed in pairs such that there are always two hollow charges situated with their openings facing each other, e) the axes of symmetry of the hollow charges are arranged in a plane perpendicular to the top side and base side, and f) the solid material is inserted with the hollow charges and the shock-absorbing material into a cage, preferably a grate-type cage, a packaging for hollow charges, which, in the event of an unintentional ignition of the hollow charges, retains the fragments, withstands the pressure generated in the packaging and permits a dissipation of pressure, is created.

The solid material ensures that fragments are captured. The pressure relief openings in the solid material allow the gas generated during a detonation of the hollow charges to escape. Axial forces, which are generated when a hollow charge is initiated (hollow charges can also be perforators), are absorbed by the shock-absorbing material. The shock-absorbing material can be constructed in a sandwich design with materials such as wood, metal and plastic for example. The solid material is covered with the shock-absorbing material on its top side and base side and the shock-absorbing material borders on the solid material here.

The feature that the axes of symmetry of the hollow charges are arranged in a plane perpendicular to the top and base side means that the axes of symmetry of the hollow charges are arranged parallel to the axis of symmetry of the packaging. As a result, when a hollow charge is initiated, the hollow charge jet is directed onto the shock-absorbing material, which borders on the solid material at the top side and base side. The hollow charge jet must not expand in the direction of the face sides of the packaging. The pressure relief openings are arranged perpendicular to the axes of symmetry of the hollow charges so that the hollow charge jet does not expand in the direction of the pressure relief openings. In this respect, the terms top side and base side are interchangeable. All that is important is that the top side and base side extend perpendicular to the axis of symmetry of the packaging and perpendicular to the axes of symmetry of the hollow charges.

The hollow charges are packed in pairs such that there are always two hollow charges situated with their openings facing each other. This has the advantage that, when one hollow charge is detonated, the other hollow charge is destroyed. Because the axes of symmetry of the hollow charges are arranged in a plane perpendicular to the top and base side, the hollow charge jets generated during a detonation are directed onto the shock-absorbing material and are dissipated there.

According to the invention, the solid material is inserted with the hollow charges and the shock-absorbing material into a cage, preferably a grate-type cage. This captures larger ejected pieces of the inner packaging and the hollow charges and, at the same time, allows the pressure wave through.

The solid material, which captures the fragments, and the pressure relief openings are arranged with respect to one another such that, when a hollow charge is initiated, the fragments generated thereby are captured in the solid material at the latest by the shock-absorbing material and do not leave the packaging.

The solid material is preferably wood or plastic.

In a preferred embodiment, the solid material consists of three sandwich-like layers arranged one above the other, and a gap, which forms the pressure relief openings, is arranged between the layers. The gap is preferably arranged in a plane perpendicular to the top and base side. The gas escaping during a detonation therefore leaves the cage at the face sides.

Preferably, the top and bottom layers of the solid material are designed in the form of a sheet and have closed surfaces.

Advantageously, the shock-absorbing material is constructed in sandwich design with preferably wood, metal or plastic. This enables it to be constructed extremely solidly.

Preferably, the cage is inserted in an outer packaging, preferably made of cardboard.

In a preferred embodiment, the cage, the solid material and the shock-absorbing material are designed with a cuboid shape having a base side, a top side and four face sides. This enables the hollow charges to be easily packed.

Advantageously, the cage is reinforced on its base side and its top side with a steel plate. This additionally reinforces the cage.

For easy filling, one of the face sides of the cage is in the form of a door and the door is connected to the base side by means of hinges.

The hollow charges can also be perforators.

The funnels in the hollow charges can be filled with a material to prevent the development of the hollow charge jet on initiation.

The invention is explained further below with reference to three figures.

FIG. 1 shows an empty cuboid-shaped cage 1, designed as a grate-type cage, having a base side 9, a top side 8 and four face sides 3*a*, 3*b*, 3*c*, 3*d*. The cage 1 is reinforced on its base side 9 and its top side 8 with a first and second steel plate 2, respectively. One of the face sides 3*a* can be opened to enable the cage 1 to be loaded. Here, the face side 3*a* is designed as a door 11 and connected to the base side 9 by means of hinges 4.

Figure 2:
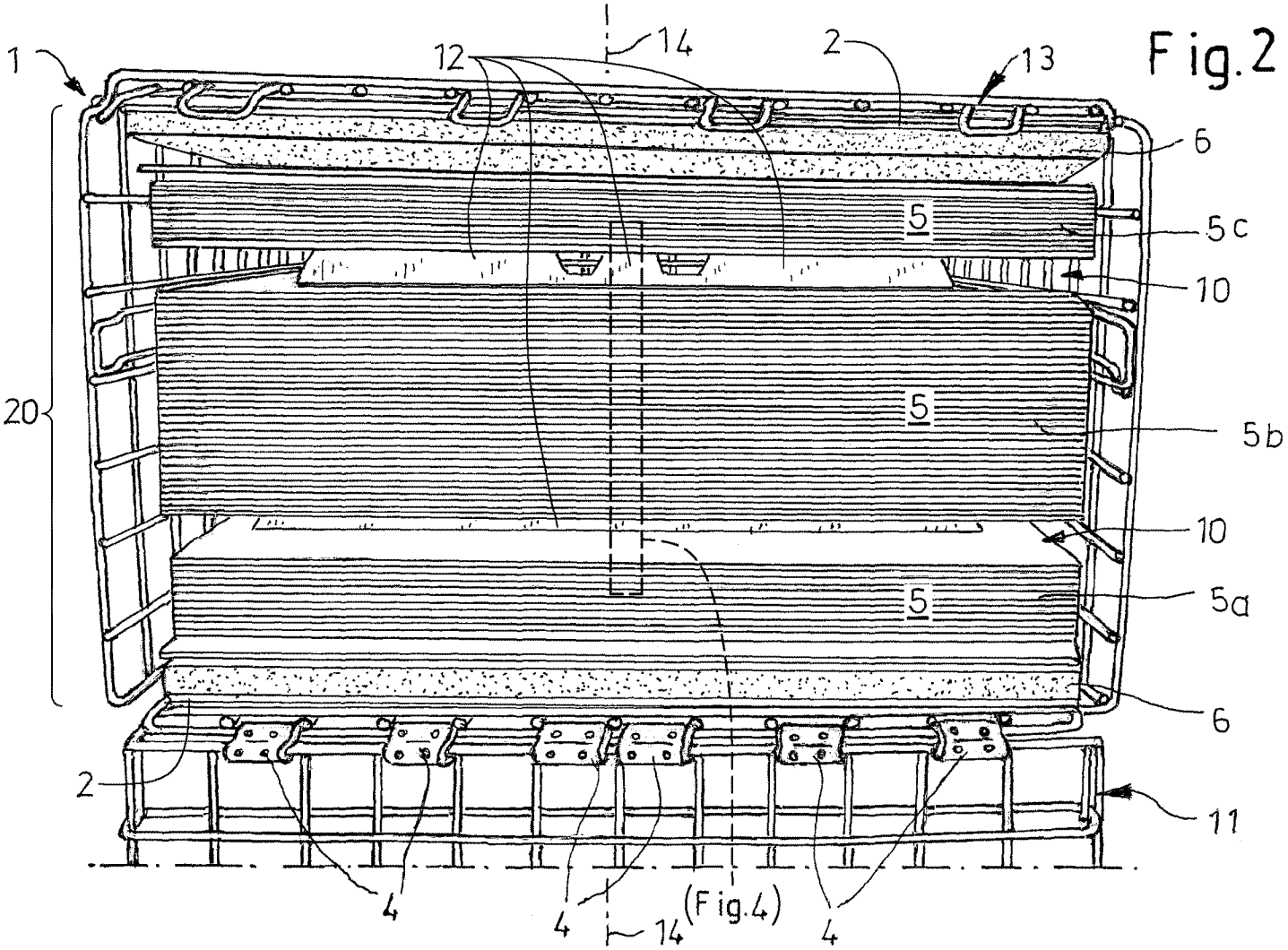
FIG. 2 is a perspective end view of the packaging FIG. 1 according to an embodiment of the invention.

FIG. 2 shows the cage 1 shown in FIG. 1 with open face side 3*a* or door 11 and filled with a multi-layered structure 20 including a plurality of layers 5 and shock absorbing material 6. The plurality of layers include solid material layers 5*a*, 5*b*, and 5*c*, in which the hollow charges 12 are inserted. The axis of symmetry 14 of the packaging is denoted by a broken line. In this embodiment, three layers—a bottom layer 5*a*, a middle layer 5*b*, and a top layer 5*c*—are arranged one above the other in the form of a sandwich. A gap 10, which forms the pressure relief openings, and through which a dissipation of pressure can take place, is provided between the individual layers 5*a* and 5*b*, as well as between layers 5*b* and 5*c*. In an embodiment, the layers 5 include a solid material, such as wood or plastic. The top layer 5*c* and the bottom layer 5*a* are designed in the form of a sheet and have closed surfaces. These two layers 5*a*, 5*c* are covered with the shock-absorbing material 6. The shock-absorbing material 6 can be constructed in a sandwich design with materials such as wood, metal and plastic for example.

Figure 3:
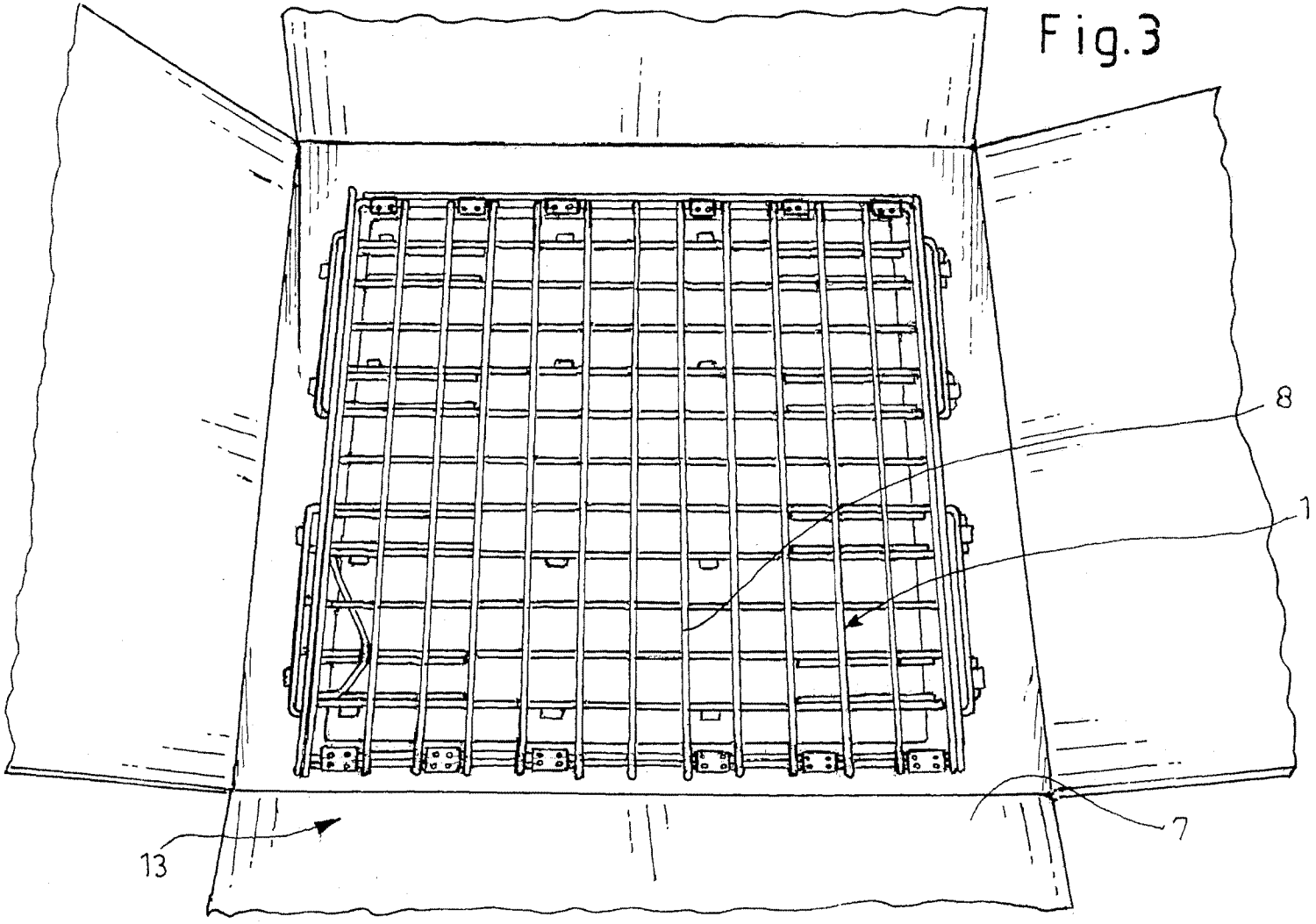
FIG. 3 is a perspective end view of the packaging of FIG. 2 according to an embodiment of the invention.
Figure 4:
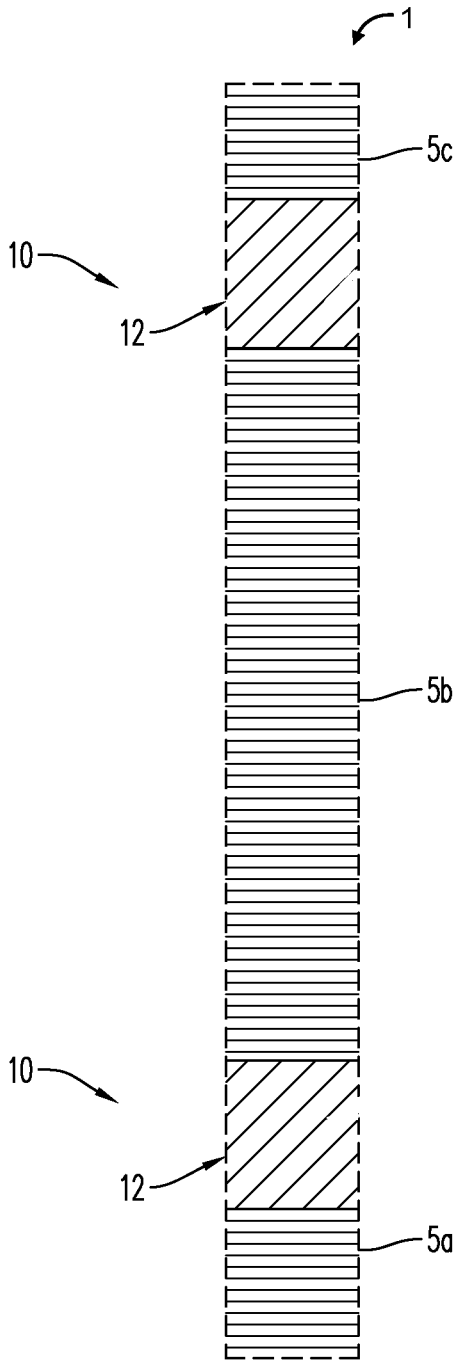

FIG. 3 shows the packaging 13 with the filled cage 1 according to FIG. 2 inserted in a cardboard box. This box forms the outer packaging 7.

The invention claimed is:

1. A cuboid shaped package configured for transport of a plurality of hollow charges, comprising:

an outer cage configured for housing a multi-layered structure therewithin, the cage comprising:

a top side;

a bottom side; and four face sides extending between the top side and the bottom side to form outer walls of the cage, wherein an axis of symmetry is defined as a line extending through a center of the cage from the top side to the bottom side of the cage; and the multi-layered structure configured for being received within the cage once the charges are positioned therein, the multi-layered structure comprising a plurality of sandwich-like layers and at least one shock absorbing material, the plurality of sandwich-like layers comprising:

a top layer;

a bottom layer;

a middle layer positioned between the top layer and the middle layer, wherein at least one of the plurality of sandwich-like layers being configured for receiving the plurality of charges packed in pairs situated with their openings facing each other and to capture fragments generated during a detonation of the charges;

a first gap formed between the top layer and the middle layer and a second gap formed between the bottom layer and the middle layer, wherein the first gap and the second gap are configured as pressure relief openings through which a pressure wave of gas volume generated during a detonation of the charges can escape; and the shock absorbing material comprising at least an upper shock absorbing material and a lower shock absorbing material.

2. The package as claimed in claim 1, wherein the plurality of sandwich-like layers comprise a solid material selected from the group comprising wood and plastic.

3. The package as claimed in claim 1, wherein the shock absorbing material comprises a material selected from the group comprising wood, metal and plastic.

4. The package as claimed in claim 1, wherein the cage is inserted in an outer packaging made of cardboard.

5. The package as claimed in claim 1, wherein:

the cage is reinforced on its top side with the first steel plate, and wherein the cage is reinforced on its bottom side with the second steel plate.

6. The package as claimed in claim 1, wherein one of the face sides of the cage is in the form of a door and the door is connected to the bottom side of the cage by means of hinges.

7. The package of claim 1, wherein the cage comprises a grate-type cage.

8. The package of claim 1, further comprising:

a first steel plate positioned between the top side of the cage and the upper shock absorbing material, and a second steel plate positioned between the bottom side of the cage and the lower shock absorbing material.

9. The package of claim 1, further comprising:

the plurality of charges.

10. The package of claim 1, further comprising:

the plurality of charges packed in pairs.

11. The package of claim 1, wherein:

the upper shock absorbing material being positioned between the top side of the cage and the top layer, and the lower shock absorbing material being positioned between the bottom side of the cage and the bottom layer.

12. The package of claim 1, wherein the top layer and the bottom layer are designed in the form of a sheet and have closed surfaces.

* * * * *